US007901246B2

(12) United States Patent
Takayama

(10) Patent No.: US 7,901,246 B2
(45) Date of Patent: Mar. 8, 2011

(54) CABLE CONNECTION STRUCTURE

(75) Inventor: Tsutomu Takayama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/565,346

(22) Filed: Sep. 23, 2009

(65) Prior Publication Data

US 2010/0112858 A1 May 6, 2010

(30) Foreign Application Priority Data

Oct. 30, 2008 (JP) ..... 2008-279315

(51) Int. Cl.
*H01R 9/05* (2006.01)

(52) U.S. Cl. ..... 439/585

(58) Field of Classification Search ..... 439/585, 439/502, 63, 581
See application file for complete search history.

(56) References Cited

U.S. PATENT DOCUMENTS 4,624,525 A * 11/1986 Ichimura et al. ..... 439/596
6,299,481 B1 * 10/2001 Doi ..... 439/607.49
6,527,592 B2 * 3/2003 Mochizuki et al. ..... 439/660
2007/0072455 A1 3/2007 Onuma

FOREIGN PATENT DOCUMENTS

JP 2001-223040 A 8/2001
JP 2007-095489 A 4/2007

* cited by examiner

*Primary Examiner* — Jean F Duverne
(74) *Attorney, Agent, or Firm* — Sughrue Mion, PLLC

(57) ABSTRACT

A cable connection structure includes a coaxial cable that includes an inner conductor, an inner insulator covering the inner conductor, a braided wire covering the inner insulator, and a sheath covering the braided wire, a cable that includes a core wire and a sheath covering the core wire, and is arranged in series with the coaxial cable, a ground terminal that connects the braided wire to a ground, and fixes the coaxial cable and the cable, a crimp terminal that press-clamps the inner conductor of the coaxial cable and the core wire of the cable to electrically connect to each other, and an insulative heat-shrinkable tube that covers the coaxial cable, the cable, and the crimp terminal. The inner conductor, exposed from the inner insulator and arranged between the crimp terminal and an end portion of the inner insulator of the coaxial cable in the heat-shrinkable tube, has a bent portion.

4 Claims, 5 Drawing Sheets

CABLE CONNECTION STRUCTURE

BACKGROUND

This invention relates to a structure of cable connection over an ground terminal, in which a coaxial cable and an ordinary cable are fixed to the ground terminal mounted, for example, on an on-vehicle antenna mounting portion, and also a braided wire of the coaxial cable is connected to the ground terminal as earth.

FIG. 3 is an exploded perspective view of a related structure of cable connection over an ground terminal used in a vehicle, and FIG. 4 is a perspective view showing the structure of FIG. 3 in its assembled condition.

The cable connection structure shown in FIGS. 3 and 4 is disclosed in Patent Literature 1 mentioned below. The ground terminal (also called "earth plate") 1 is a terminal formed of a metal plate or a metal sheet and including a grounding plate portion 2 to be fixedly mounted on a grounding structural member (not shown) such for example as an on-vehicle antenna-mounting portion (e.g. a vehicle frame) of a vehicle. The grounding plate portion 2 has a mounting hole 2*a* through which it is screw fastened to the grounding structural member.

The coaxial cable 11 and an ordinary cable (power cable) 21 which are to be used at the above on-vehicle antenna mounting portion or other portion are fixed onto the ground terminal 1.

One end portion of the coaxial cable 11 to be connected to the ordinary cable 21 is beforehand subjected to an end processing operation in which a sheath 12, a braided wire 13 and an inner insulator 14 are cut off or removed over respective predetermined lengths, so that exposed portions of the braided wire 13, inner insulator 14 and inner conductor 15 are formed at the one end portion of the coaxial cable as shown in FIG. 3.

One end portion of the ordinary cable 21 to be connected to the coaxial cable 11 is beforehand subjected to an end processing operation in which a sheath 22 is cut off or removed over a predetermined length, so that an exposed portion of a core wire (conductor) 23 is formed at the one end portion of the ordinary cable 21 as shown in FIG. 3.

The exposed portion of the inner conductor 15 of the coaxial cable 11 and the exposed portion of the core wire 23 of the ordinary cable 21 are arranged in line with each other, and are press-clamped to be connected together by a crimp terminal 31.

A heat-shrinkable tube 33 of an electrically-insulative nature is fitted on the portions of the cables connected by the crimp terminal 31 and its neighboring portions for insulating purposes.

As shown in FIG. 4, the heat-shrinkable tube 33 has such a length that one end portion thereof is fitted on a distal end portion of the exposed portion of the braided wire 13 of the coaxial cable 11, while the other end portion thereof is fitted on a distal end portion of the sheath 22 at the one end portion of the ordinary cable 21.

The exposed portion of the braided wire 13 disposed at the one end portion of the coaxial cable 11 has such a length that this exposed portion, although covered at its distal end portion by the heat-shrinkable tube 33, has an uncovered portion of a predetermined length lying between the one end of the heat-shrinkable tube 33 and the sheath 12 of the coaxial cable 11 as shown in FIG. 4.

The purpose of fitting the heat-shrinkable tube 33 on the distal end portion of the braided wire 13 is to prevent the distal end portion of the braided wire 13 from becoming loose.

As shown in FIG. 3, the grounding plate portion 2 has a first sheath clamping portion 4, a second sheath clamping portion 5 and a braided wire clamping portion 6 which are formed integrally at one end edge portion thereof. The first sheath clamping portion 4 is press-fastened onto the sheath 12 of the coaxial cable 11 so as to fix the coaxial cable 11, and the second sheath clamping portion 5 is spaced from the first sheath clamping portion 4 in the direction of lengths of the cables 11 and 21, and is press-fastened onto the heat-shrinkable tube 33 fitted on the sheath 22 of the ordinary cable 21 so as to fix the ordinary cable 21, and the braided wire clamping portion 6 is disposed between the first and second clamping portions 4 and 5, and is press-fastened onto the uncovered portion of the exposed braided wire 13 so as to groundedly connect the braided wire 13 to the grounding plate portion 2.

Namely, the inner conductor 15 of the coaxial cable 11 and the core wire 23 of the ordinary cable 21 are electrically connected together by the crimp terminal 31, and with respect to the coaxial cable 11 and the ordinary wire 21 placed over the ground terminal 1, the coaxial cable 11 is fixed to the ground terminal 1 by press-fastening the first sheath clamping portion 4 onto the sheath 12 of the coaxial cable 11, and the ordinary cable 21 is fixed to the ground terminal 1 by press-fastening the second sheath clamping portion 5 onto the sheath 22 of the ordinary cable 21 through the heat-shrinkable tube 33, as shown in FIG. 4. Further, the coaxial cable 11 is groundedly connected to the ground terminal 1 by press-fastening the braided wire clamping portion 6 onto the uncovered portion of the braided wire 13 exposed adjacent to the one end of the heat-shrinkable tube 33.

[Patent Literature 1] JP-A-2007-95489

[Patent Literature 2] JP-A-2001-223040

Incidentally, generally, the inner conductor 15 of the coaxial cable 11 has a smaller thickness and a lower strength than the core wire 23 of the ordinary cable 21.

In the above cable connection structure, the inner conductor 15 of a low strength is exposed at a region indicated by A in FIG. 5, and therefore there is encountered a problem that when the inner insulator 14 and the heat-shrinkable tube 33 are expanded and contracted according to an ambient temperature change, etc., a tensile stress and a compressive stress immediately act on the inner conductor 15, so that the inner conductor 15 is liable to be damaged.

Arrows $\sigma 1$ and $\sigma 2$ in FIG. 5 indicate tensile stresses acting on the exposed portion of the inner conductor 15 when the inner insulator 14 and the heat-shrinkable tube 33 are contracted.

SUMMARY

It is therefore an object of this invention to solve the above problem, and more specifically to provide a structure of cable connection over an ground terminal, in which stresses are restrained from acting on an inner conductor of a coaxial cable exposed over the ground terminal, thereby preventing the inner conductor from being damaged by the stresses.

The above object has been achieved by the following constructions.

(1) There is provided a cable connection structure comprising:

a coaxial cable that includes an inner conductor, an inner insulator covering the inner conductor, a braided wire covering the inner insulator, and a sheath covering the braided wire;

a cable that includes a core wire and a sheath covering the core wire, and is arranged in series with the coaxial cable;

a ground terminal that connects the braided wire to a ground, and fixes the coaxial cable and the cable;

a crimp terminal that press-clamps the inner conductor of the coaxial cable and the core wire of the cable to electrically connect to each other; and an insulative heat-shrinkable tube that covers the coaxial cable, the cable, and the crimp terminal, wherein the inner conductor, exposed from the inner insulator and arranged between the crimp terminal and an end portion of the inner insulator of the coaxial cable in the heat-shrinkable tube, has a bent portion.

Preferably, the ground terminal is formed of a metal plate and includes:

a first sheath clamping portion which press-fastens to the sheath of the coaxial cable for fixing the coaxial cable;

a second sheath clamping portion which press-fastens to the sheath of the cable through the heat-shrinkable tube for fixing the cable; and a braided wire clamping portion which press-fastens to the braided wire of the coaxial cable, and is arranged between the first sheath clamping portion and the second sheath clamping portion for grounding the coaxial cable.

Preferably, the heat-shrinkable tube covers from an end portion of the braided wire exposed at an end portion of the coaxial cable to the sheath of an end portion of the cable.

(2) Preferably, the bent portion of the inner conductor of the coaxial cable is formed into a curved shape projecting in a direction of increasing of a distance between the inner conductor and the ground terminal.

Also, preferably, the bent portion of the inner conductor of the coaxial cable is formed into a curved shape projecting in a direction perpendicular to an arrangement direction of the coaxial cable and the cable.

In the construction of the above Paragraph (1), when the inner insulator and the heat-shrinkable tube are expanded and contracted according to an ambient temperature change, etc., the bent portion of the inner conductor disposed within the heat-shrinkable tube and exposed from the inner insulator over the ground terminal is expanded and contracted, thereby allowing the displacement of the inner insulator and the heat-shrinkable tube so as to restrain stresses from acting on the inner conductor. Therefore, the inner conductor is prevented from being damaged by the stresses.

In the construction of the above Paragraph (2), even when the bent portion of the inner conductor is expanded and contracted in accordance with the displacement of the inner insulator and the heat-shrinkable tube, the distance between the inner conductor and the ground terminal (to which the braided wire of the coaxial cable is grounded) can be maintained at a level not smaller than the reference distance, and therefore the inner conductor is prevented from being moved too close to the ground terminal, thus preventing cable characteristics from being lowered.

In the structure of cable connection over the ground terminal provided according to the invention, the bent portion is formed at the portion of the inner conductor exposed from the inner insulator over the ground terminal, and therefore when the inner insulator and the heat-shrinkable tube are expanded and contracted according to an ambient temperature change, etc., the bent portion of the inner conductor is expanded and contracted, thereby allowing the displacement of the inner insulator and the heat-shrinkable tube.

Therefore, stresses are restrained from acting on the inner conductor, and the inner conductor is prevented from being damaged by the stresses.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A structure of cable connection over an ground terminal provided in accordance with a preferred embodiment of the present invention will now be described in detail with reference to the drawings.

Figure 1:
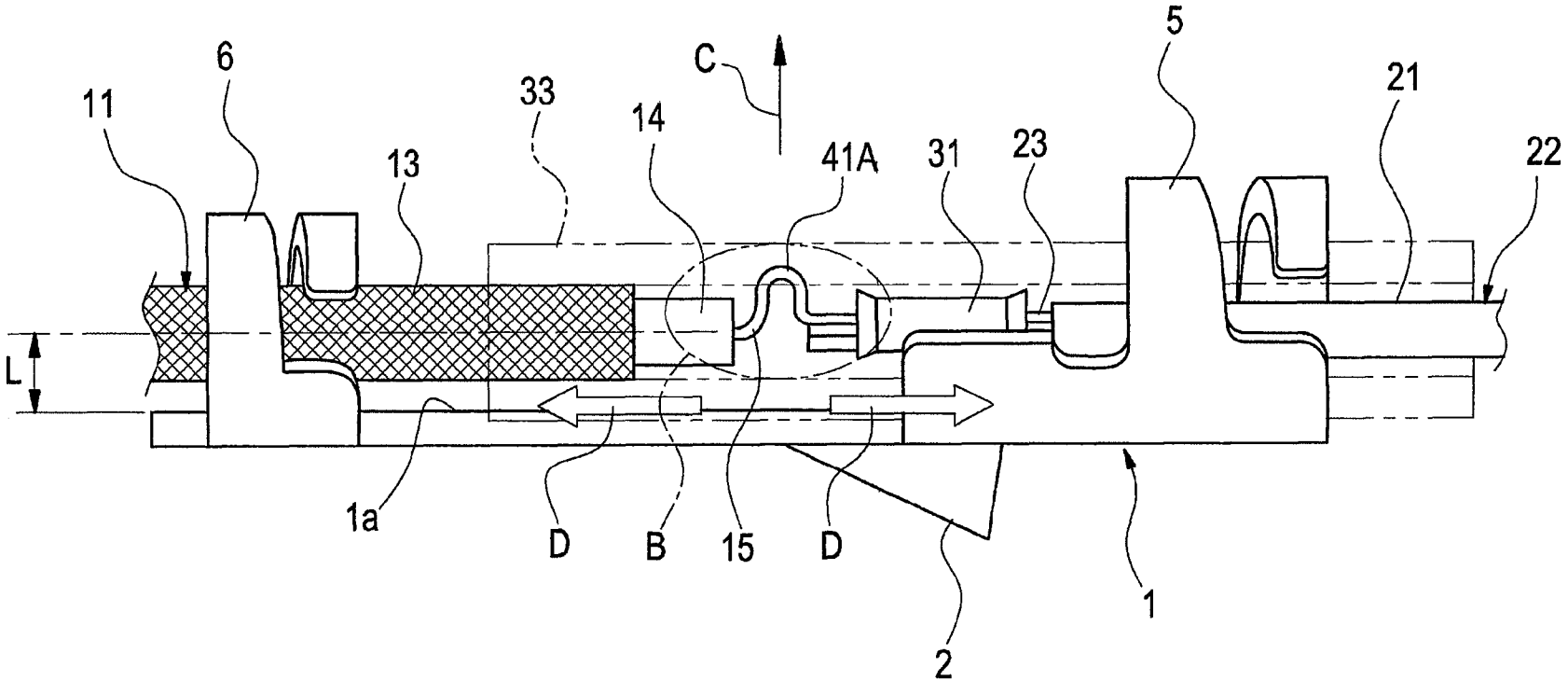
FIG. 1 is a view showing an important portion of a structure of cable connection over an ground terminal provided in accordance with one preferred embodiment of the present invention.
Figures 2A, 2B:
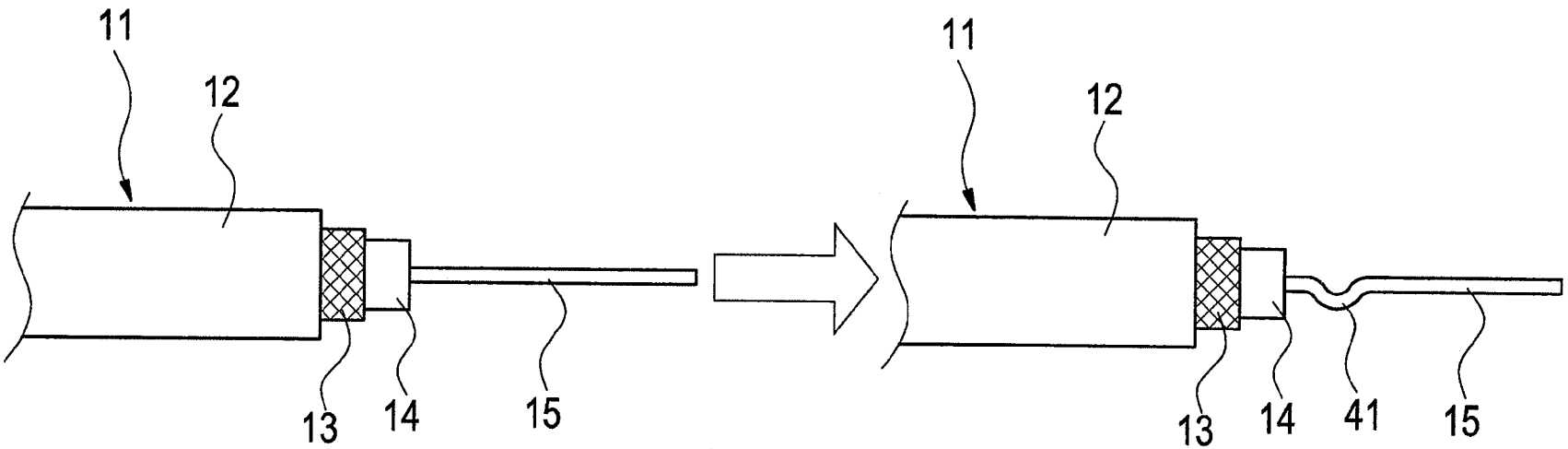
FIGS. 2A and 2B are views showing the process of forming a bent portion at an inner conductor of a coaxial cable shown in FIG. 1.

FIG. 1 is a view showing an important portion of the cable connection structure of the invention, and FIGS. 2A and 2B are views showing the process of forming a bent portion at an inner conductor of a coaxial cable shown in FIG. 1.

In the cable connection structure of this embodiment, the inner conductor 15 of the coaxial cable 11 and a core wire 23 of an ordinary cable 21 arranged in line with each other are press-clamped to be electrically connected together by a crimp terminal 31, and the coaxial cable 11 and the ordinary cable 21 are fixed onto the ground terminal 1 formed of a metal plate or sheet, and also a braided wire 13 of the coaxial cable 11 is groundedly connected to the ground terminal 1.

Figure 3:
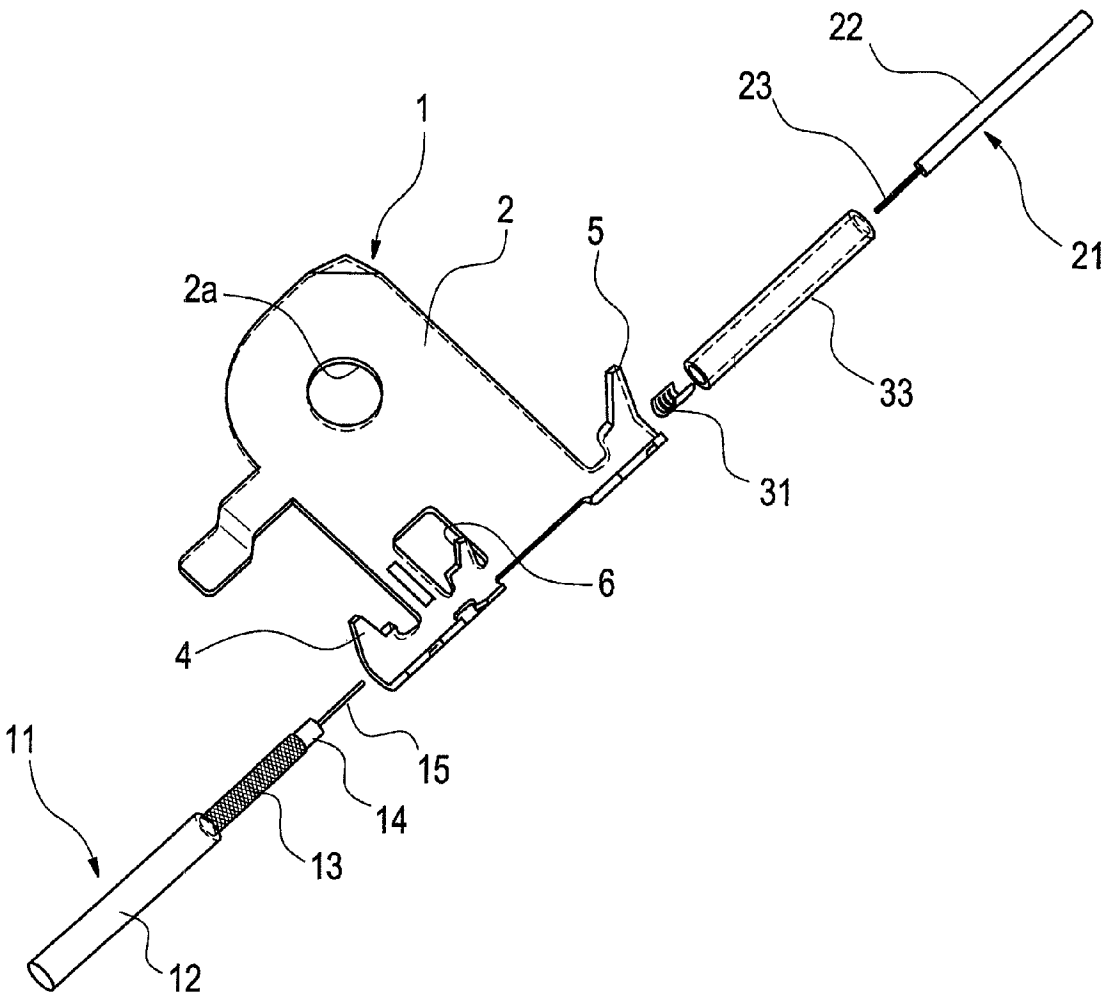
FIG. 3 is an exploded perspective view of a conventional structure of cable connection over an ground terminal.
Figure 4:
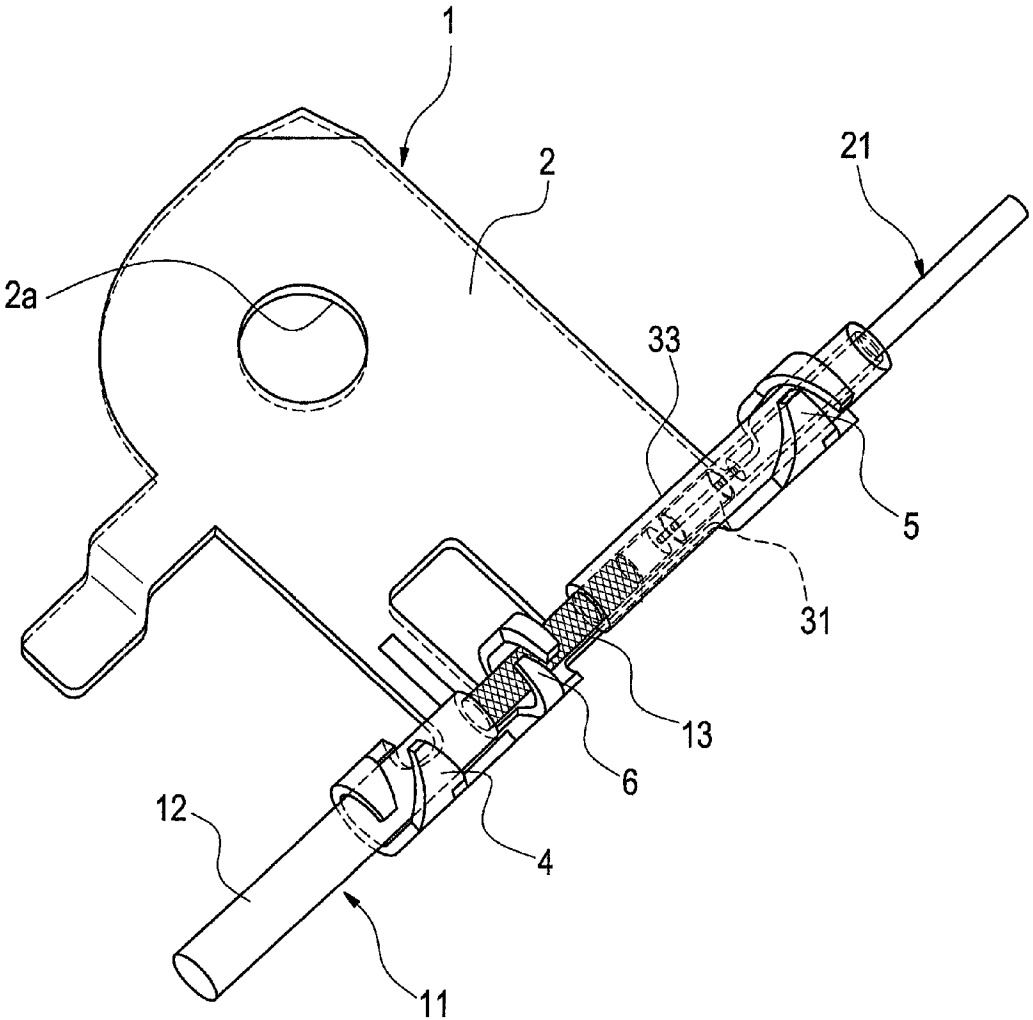
FIG. 4 is a perspective view of the conventional cable connection structure in its assembled condition.
Figure 5:
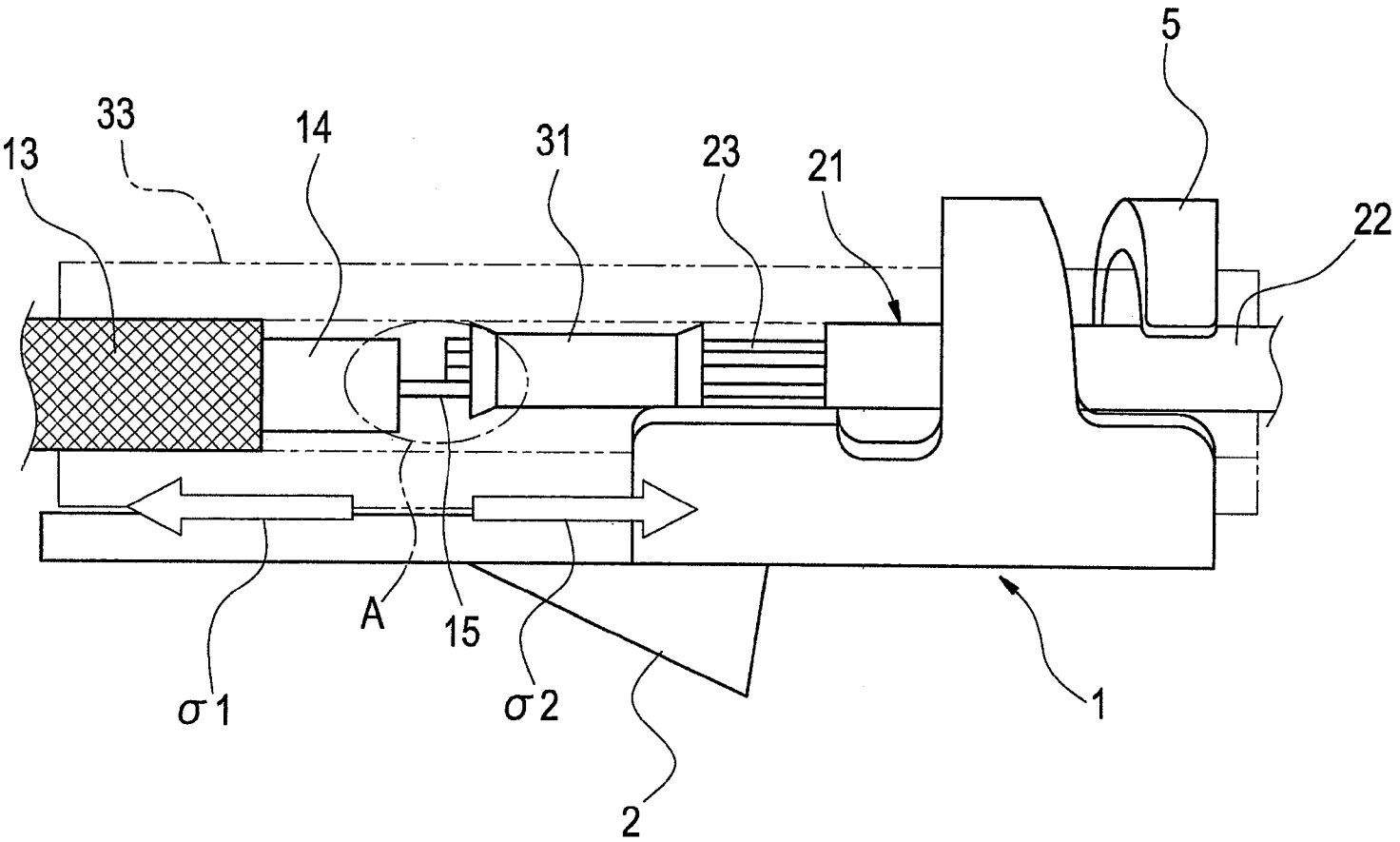
FIG. 5 is an enlarged view of an important portion of the conventional cable connection structure.

The ground terminal 1 used in this embodiment has the same structure as the ground terminal shown in FIG. 3, and includes a grounding plate portion 2 for being fixedly mounted on a grounding structural member such for example as an on-vehicle antenna-mounting portion (e.g. a vehicle frame) of a vehicle. The grounding plate portion 2 has a first sheath clamping portion 4, a second sheath clamping portion 5 and a braided wire clamping portion 6 which are formed integrally at one end edge portion thereof. The first sheath clamping portion 4 is press-fastened onto a sheath 12 of the coaxial cable 11 so as to fix the coaxial cable 11, and the second sheath clamping portion 5 is spaced from the first sheath clamping portion 4 in the direction of lengths of the cables 11 and 21, and is press-fastened onto a heat-shrinkable tube 33 fitted on a sheath 22 of the ordinary cable 21 so as to fix the ordinary cable 21, and the braided wire clamping portion 6 is disposed between the first and second clamping portions 4 and 5, and is press-fastened onto an uncovered (exposed) portion of a braided wire 13 so as to groundedly connect the braided wire 13 to the grounding plate portion 2.

One end portion of the coaxial cable 11 to be connected to the ordinary cable 21 is beforehand subjected to an end processing operation in which the sheath 12, the braided wire 13 and an inner insulator 14 are cut off or removed over respective predetermined lengths, so that exposed portions of the braided wire 13, inner insulator 14 and inner conductor 15 are formed at the one end portion of the coaxial cable 11 as shown in FIG. 2A. Further, a curved portion 41 for forming the bent portion 41A (described later) is formed at that portion of the exposed inner conductor 15 exposed from the inner insulator 14 and disposed near to the inner insulator 14.

One end portion of the ordinary cable 21 to be connected to the coaxial cable 11 is beforehand subjected to an end processing operation in which the sheath 22 is cut off or removed over a predetermined length, so that the core wire 23 is exposed over a predetermined length as shown in FIG. 3.

A distal end portion of the exposed portion of the inner conductor 15 at the one end portion of the coaxial cable 11 and a distal end portion of the exposed portion of the core wire 23 at the one end portion of the ordinary cable are butted together or arranged in line with each other, and are press-clamped to be connected together by a crimp terminal 31.

The heat-shrinkable tube 33 of an electrically-insulative nature is fitted on the portions of the cables connected by the crimp terminal 31 and its neighboring portions for insulating purposes.

As shown in FIG. 1, the heat-shrinkable tube 33 has such a length that one end portion thereof is fitted on a distal end portion of the exposed portion of the braided wire 13 of the coaxial cable 11, while the other end portion thereof is fitted on a distal end portion of the sheath 22 at the one end portion of the ordinary cable 21.

The exposed portion of the braided wire 13 disposed at the one end portion of the coaxial cable 11 has such a length that this exposed portion, although covered at its distal end portion by the heat-shrinkable tube 33, has the uncovered portion of a predetermined length lying between the one end of the heat-shrinkable tube 33 and the sheath 12 of the coaxial cable 11 as shown in FIG. 1.

The purpose of fitting the heat-shrinkable tube 33 on the distal end portion of the braided wire 13 is to prevent the distal end portion of the braided wire 13 from becoming loose.

In this embodiment, also, the coaxial cable 11 is fixed to the ground terminal 1 by press-fastening the first sheath clamping portion 4 of the ground terminal 1 onto the sheath 12 of the coaxial cable. The ordinary cable 21 is fixed to the ground terminal 1 by press-fastening the second sheath clamping portion 5 of the ground terminal 1 onto the sheath 22 of the ordinary cable 21 through the heat-shrinkable tube 33. Further, the coaxial cable 11 is groundedly connected to the ground terminal 1 by press-fastening the braided wire clamping portion 6 of the ground terminal 1 onto the uncovered portion of the exposed portion of the braided wire 13 disposed adjacent to the one end of the heat-shrinkable tube 33.

In this embodiment, utilizing the curved portion 41 of FIG. 2B, the bent portion (or slack portion) 41A is formed at that portion of the inner conductor 15 disposed within the heat-shrinkable tube 33 and exposed between the crimp terminal 31 and the distal end of the inner insulator 14 of the coaxial cable 11, as shown at a portion B of FIG. 1.

In FIG. 1, a dimension L represents the distance from the center (axis) of the inner conductor 15 of the coaxial cable 11 (fixed to the ground terminal 1 by press-fastening the braid wire clamping portion 6 onto the braided wire 13) from a surface 1*a* of the ground terminal 1. The bent portion 41A is held in a curved shape over the ground terminal 1, and projects in a direction of increasing of the distance between the inner conductor 15 and the ground terminal 1 (that is, projects in a direction C (FIG. 1) away from the surface 1*a* of the ground terminal 1).

In the above cable connection structure of this embodiment, when the inner insulator 14 and the heat-shrinkable tube 33 are expanded and contracted according to an ambient temperature change, etc., the bent portion 41A of the inner conductor 15 exposed from the inner insulator 14 over the ground terminal 1 is expanded and contracted, thereby allowing the displacement of the inner insulator 14 and the heat-shrinkable tube 33 so as to restrain stresses from acting on the inner conductor 15. Therefore, the inner conductor 15 is prevented from being damaged by the stresses.

In FIG. 1, arrows D indicate the directions of expansion of the bent portion 41A upon contraction of the inner conductor 14 and the heat-shrinkable tube 33.

In the above embodiment, the bent portion 41A formed at the inner conductor 15 is formed into the curved shape projecting in the direction of increasing of the distance between the inner conductor 15 and the ground terminal 1, and therefore even when the bent portion 41A of the inner conductor 15 is expanded and contracted in accordance with the displacement of the inner insulator 14 and the heat-shrinkable tube 33, the distance between the inner conductor 15 and the ground terminal 1 (to which the braided wire 13 of the coaxial cable 11 is grounded) is maintained at a level not smaller than the reference distance L (see FIG. 1), and therefore the inner conductor 15 is prevented from being moved too close to the ground terminal 1, thus preventing cable characteristics from being lowered.

The present invention is not limited to the above embodiment, and suitable modifications, improvements, etc., can be made. Furthermore, the material, shape, dimensions, numerical values, form, number, disposition, etc., of each of the constituent elements of the above embodiment are arbitrary and are not limited in so far as the invention can be achieved.

The present application is based on Japanese Patent Application No. 2008-279315 filed on Oct. 30, 2008, the contents of which are incorporated herein for reference.

What is claimed is:

1. A cable connection structure comprising:

a coaxial cable that includes an inner conductor, an inner insulator covering the inner conductor, a braided wire covering the inner insulator, and a sheath covering the braided wire;

a cable that includes a core wire and a sheath covering the core wire, and is arranged in series with the coaxial cable;

a ground terminal that connects the braided wire to a ground, and fixes the coaxial cable and the cable;

a crimp terminal that press-clamps the inner conductor of the coaxial cable and the core wire of the cable to electrically connect to each other; and an insulative heat-shrinkable tube that covers the coaxial cable, the cable, and the crimp terminal, wherein the inner conductor, exposed from the inner insulator and arranged between the crimp terminal and an end portion of the inner insulator of the coaxial cable in the heat-shrinkable tube, has a bent portion;

wherein the ground terminal is formed of a metal plate and includes:

a first sheath clamping portion which press-fastens to the sheath of the coaxial cable for fixing the coaxial cable;

a second sheath clamping portion which press-fastens to the sheath of the cable through the heat-shrinkable tube for fixing the cable; and a braided wire clamping portion which press-fastens to the braided wire of the coaxial cable, and is arranged between the first sheath clamping portion and the second sheath clamping portion for grounding the coaxial cable.

2. The cable connection structure according to claim 1, wherein the heat-shrinkable tube covers from an end portion of the braided wire exposed at an end portion of the coaxial cable to the sheath of an end portion of the cable.

3. The cable connection structure according to claim 1, wherein the bent portion of the inner conductor of the coaxial cable is formed into a curved shape projecting in a direction of increasing of a distance between the inner conductor and the ground terminal.

4. The cable connection structure according to claim 1, wherein the bent portion of the inner conductor of the coaxial cable is formed into a curved shape projecting in a direction perpendicular to an arrangement direction of the coaxial cable and the cable.

* * * * *